US005546969A

United States Patent [19]

Vilen

[11] Patent Number: 5,546,969

[45] Date of Patent: Aug. 20, 1996

[54] DISHWASHING MACHINE WITH INTEGRATED RECYCLING SYSTEM

[75] Inventor: Erik O. Vilen, Oakbrook, Ill.

[73] Assignee: Blako Inc., Chicago, Ill.

[21] Appl. No.: 433,144

[22] Filed: May 3, 1995

[51] Int. Cl.[6] ..... A47L 15/42

[52] U.S. Cl. ..... 134/188; 134/176; 134/191

[58] Field of Search ..... 134/72, 111, 176, 134/179, 180, 181, 186, 188, 191, 195, 199

[56] References Cited

U.S. PATENT DOCUMENTS

| | | | |
|---|---|---|---|
| 1,009,223 | 11/1911 | Cochrane | 134/176 |
| 1,528,069 | 3/1925 | Merseles | 134/176 X |
| 1,597,361 | 8/1926 | Hazard et al. | 134/176 X |
| 1,645,815 | 10/1927 | Murdoch | 134/191 X |
| 1,675,192 | 6/1928 | Murdoch | 134/176 |
| 1,701,066 | 2/1929 | Elkington | 134/176 X |
| 1,980,065 | 11/1934 | Johnston | 134/176 X |
| 3,049,132 | 8/1962 | Gilson | 134/186 X |

*Primary Examiner*—Philip R. Coe
*Attorney, Agent, or Firm*—Emrich & Dithmar

[57] ABSTRACT

An integrated recycling system for dishwashing machine includes an impeller positioned within the sump of the dishwashing machine, an impeller housing enclosing the impeller within the sump, and a motor for rotating the impeller within the impeller housing whereby a flow of water is achieved from the sump to one or more spray arm assemblies of the dishwashing machine, the impeller housing being formed from a strip of sheet metal that is cut to the proper length and wound around the impeller, defining an arcuate-shaped peripheral wall portion of the impeller housing that is open on opposing sides, one side being closed by a plate member and the other side being closed by a wall of the sump on which the impeller housing is mounted.

15 Claims, 2 Drawing Sheets

DISHWASHING MACHINE WITH INTEGRATED RECYCLING SYSTEM

BACKGROUND OF THE INVENTION

This invention relates to commercial dishwashing machines, and more particularly to a dishwashing machine including an integrated recycling system for recycling water through the dishwashing machine.

Commercial dishwashing machines include a wash chamber having spray units located therein which are adapted for spraying wash water and rinse water onto racks of dishes that are positioned within the wash chamber. The dishwashing machines may be single station type units in which dishes to be washed is maintained in the wash chamber during the wash and rinse cycles, or multi-station units in which the dishes are moved through the unit on a conveyor apparatus. Conventionally, commercial dishwashing machines include upper and lower wash spray units and upper and lower rinse spray units to ensure that the rack of dishes is sprayed from above and below during the wash and rinse cycles. Typically, at least the wash water that is supplied to the upper and lower wash spray units is recirculated through the dishwashing machine by a recycling system which includes a pump that draws wash water from a sump and supplies the wash water to the upper and lower spray units. The wash water is returned to the sump through a suitable filter to be recirculated.

The two primary ways of recycling wash water in a dishwashing machine are by utilizing an external pump system or an internal pump system. In an external pump system, the pump motor and the impeller are contained within a pump housing forming a pump assembly that is mounted externally to the sump. The inlet of the pump assembly is connected through a filter to an output of the sump, allowing the pump assembly to draw wash water from the sump and pump the wash water to the upper and lower wash spray units of the dishwashing machine. In an internal pump system, the pump motor is located externally of the sump, but the impeller and the pump housing are mounted within the sump of the dishwashing machine. When the impeller is rotated by the pump motor, wash water from the sump is drawn into the pump housing and pumped to the upper and lower wash spray units of the dishwashing machine.

A significant shortcoming of external and internal pump systems is the need to cast or fabricate a complex pump housing adapted to mounted either inside or outside the housing of the dishwashing machine. Such a requirement may add as much as $100.00 to the fabrication costs of the pump assembly.

SUMMARY OF INVENTION

The present invention provides an integrated recycling system for dishwashing machines for recirculating water through the dishwashing machine. The integrated recycling system includes an impeller positioned within a sump of the dishwashing machine, an impeller shield or housing mounted around the impeller, and a motor for rotating the impeller within the impeller housing, whereby a flow of water is achieved from the sump to spray means of the dishwashing machine. The impeller housing is a simple arcuate shaped member that is fabricated from a strip of sheet metal that is cut to the proper length and is then wound around the impeller to define a peripheral wall for the impeller housing that is open at opposite sides. One side of the strip of sheet metal is secured to the inner side wall of the sump, closing the impeller housing on that side. The other side of the sheet metal strip is closed by an end plate that is secured to the sheet metal strip, the end plate having an aperture therethrough through which water in the sump is drawn into the impeller housing by the action of the impeller as the impeller is rotated. By positioning the impeller in the sump of the dishwashing machine and by enclosing the impeller within the simple fabricated housing according to the present invention, the efficient flow of water under pressure is provided to upper and lower spray assemblies of the dishwashing machine.

The impeller housing of the recycling system provided by the present invention is easy to fabricate and very inexpensive to manufacture. The impeller housing replaces the cast or machined pump housing that is required for conventional pump assemblies and is simpler, cheaper and just as efficient. The housing costs merely a few pennies to fabricate and totally eliminates the necessity of casing or fabricating a complex pump impeller housing for either internal or external mounted pump assemblies. This results in a cost savings on the order of approximately $100.00 per unit in fabrication costs as compared with conventional external and internal pump systems.

The invention consists of certain novel features and structural details hereinafter fully described, illustrated in the accompanying drawings, and particularly pointed out in the appended claims, it being understood that various changes in the details may be made without departing from the spirit or sacrificing any of the advantages of the present invention.

DESCRIPTION OF THE DRAWINGS

For the purposes of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF THE PREFERRED EMBODIMENT

Figure 1:
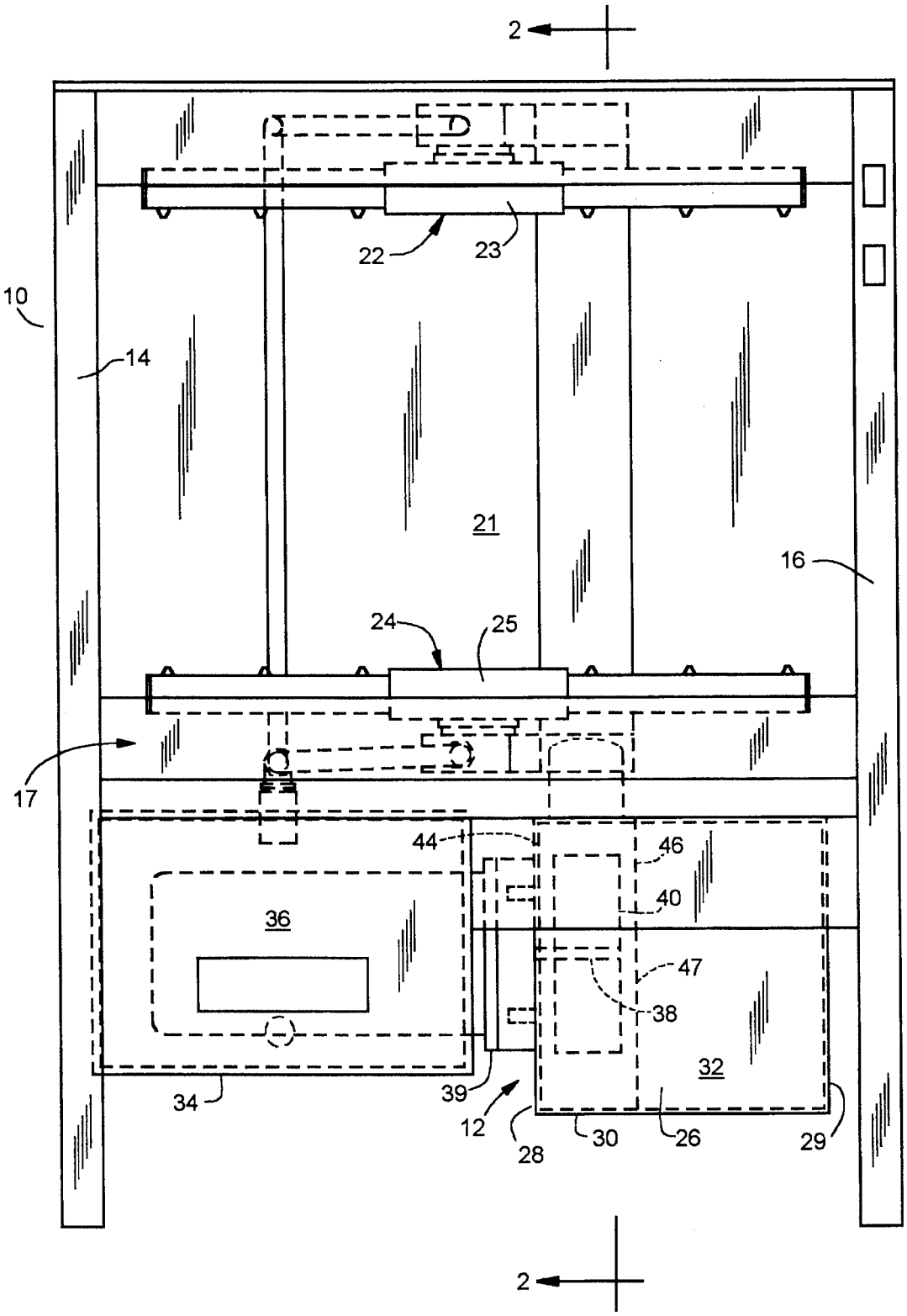
FIG. 1 is a front elevation view of a dishwashing machine which incorporates the integrated recycling system provided by the invention.
Figure 2:
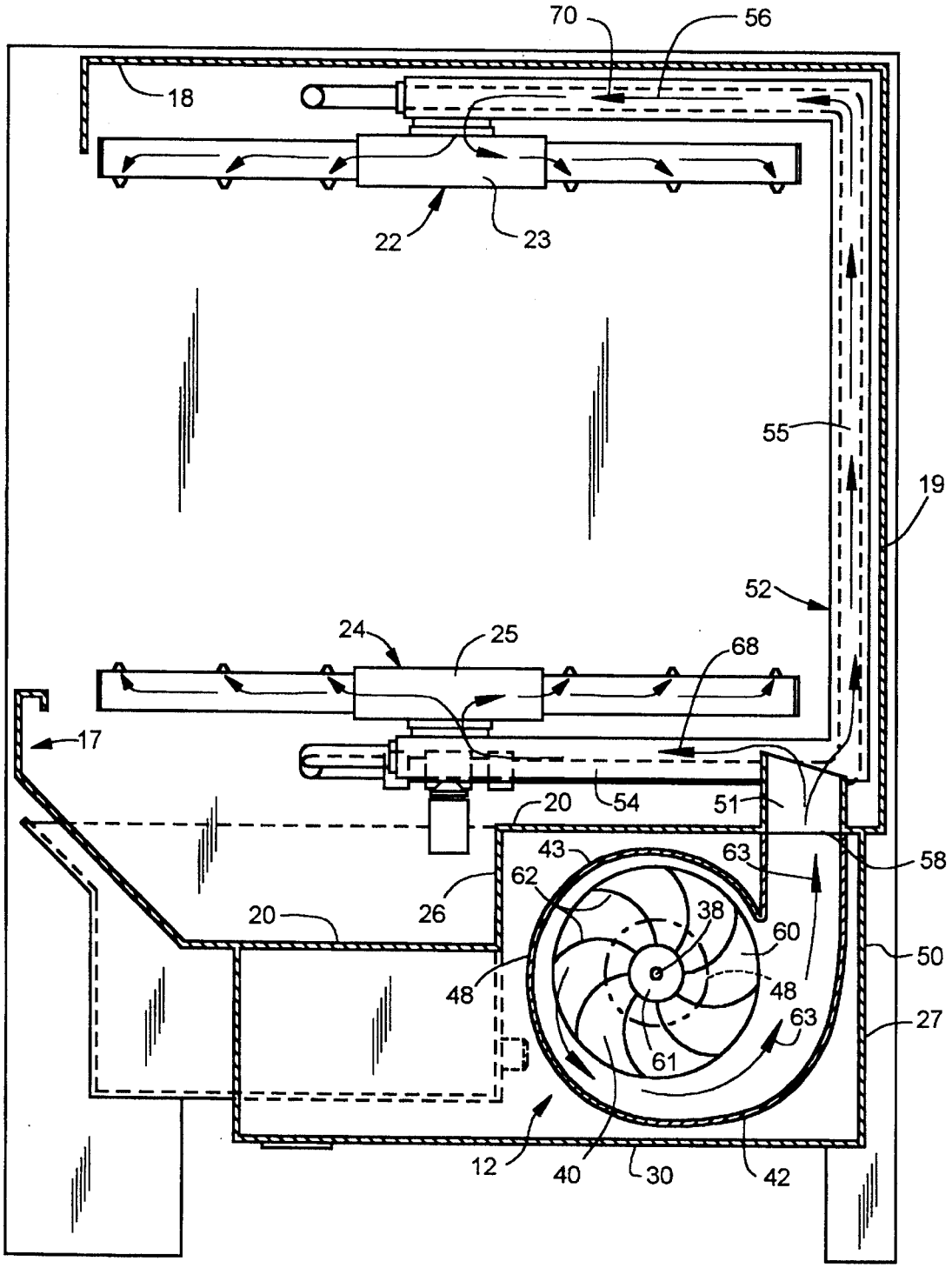
FIG. 2 is a vertical section view taken along the line 2—2 of FIG. 1 and illustrating the water flow paths through the dishwashing machine as the result of operation of the integrated recycling system of the invention.

Referring to the drawings, FIGS. 1 and 2 illustrate a dishwashing machine 10 incorporating the integrated recycling system 12 according to the invention. The dishwashing machine may be a single station type unit in which a rack of dishes to be washed is maintained in the wash chamber of the dishwashing machine during pre-rinse, wash and final rinse cycles, or a multi-station unit in which dishes are moved through the unit on a conveyor apparatus. The integrated recycling system 12 recycles at least wash water through the dishwashing machine during the wash cycles.

The dishwashing machine 10 includes a pair of side upright members 14 and 16 which support a partition member 17 on a floor. The partition member 17 divides the interior of the dishwashing machine into a wash chamber 21, a sump 32 and a motor compartment 34. The partition member 17 includes an upper portion including a top wall 18, a back wall 19 and a bottom wall 20 which together with sides 14 and 16 define the wash chamber 21 for the dishwashing machine. An upper spray assembly 22, including an upper wash spray arm 23, is located in the upper portion of the wash chamber 21. A lower spray assembly 24, including a lower wash spray arm 25, is located in the lower portion of the wash chamber 21. Wash water is supplied to the upper and lower wash spray arms by the recycling system 12.

A lower portion of the partition member 17 includes a front wall 26, a back wall 27, a side wall 28, a side wall 29 and a bottom wall 30 which define the sump 32, the upper end of is partially closed by the bottom wall 20. The upper end of the sump 32 is communicated with the bottom of the wash chamber 21 to permit wash water discharged from the upper spray assembly 22 and the lower spray assembly 24 of the dishwashing machine to be returned to the sump 32 and pumped back to the upper and lower spray assemblies by recycling system 12 during a wash cycle. The wash water that is discharged from the upper and lower spray assemblies can be returned to the sump 32 through a suitable filter (not shown) in the manner known in the art. A further portion of the partition member defines the motor compartment 34 at the bottom of the partition member 17 for housing the pump motor 36. The pump motor 36 is mounted on the outer surface of side wall 28 of the sump 32 in a suitable manner with the motor shaft 38 extending through an aperture in the side wall 28 and sealed thereto by a seal assembly 39. The side upright members 14 and 16 and the upper and lower portions of the partition member 17 are made of steel or other durable metal as is conventional in dishwashing machines.

The upper and lower wash spray arms are mounted within the wash chamber 21 such that a rack dishes (not shown) is effectively sprayed from above and below with wash water while located within the effective wash area. The pressure and spray pattern of wash water delivered during the washing operation is sufficient to remove physical soil from all portions of the racked dishes. Typically, the temperature of the wash water is between 140° F. A final rinse spray is provided from nozzles (not shown) above and below the upper and lower wash spray arms, as is known in the art.

At least the wash water that is supplied to the upper and lower wash spray arms is recirculated through the dishwashing machine 10 by the integrated recycling system 12 provided by the present invention. The recycling system 12 includes an impeller 40 that is located within a shield or housing 42 that is located in the sump 32 and driven by the pump motor 36. The housing is secured to the lower wall 20 and side wall 28 of the partition member 17.

The impeller housing 42 includes a strip of sheet metal 43, two to three inches wide, that is cut to the proper length and wound around the impeller 40. The sheet metal strip 43 defines a peripheral wall for the impeller housing which is closed at one side 44 by side wall 28 of the sump 32 and closed at its opposite side 46 by a side plate 47. The side plate 47 has a circular aperture 48 therethrough for permitting wash water contained within the sump 32 to be drawn into the impeller housing 42 by the impeller 40 as the impeller is rotated by the pump motor 36. The aperture 48 is a few inches in diameter and is located coaxially with the motor shaft 38, as shown by the dotted circle 48 in FIG. 2. The impeller housing 42 includes a first portion 49 that is somewhat circular in shape, having a reduced radius at the top than at the bottom, and defining a diverging water flow path around the impeller 40 and which merges through a converging throat portion 50 with an outlet portion 51 of the housing 42 which is a generally straight section of sheet metal that extends through an aperture 58 in the bottom wall 20 of the partition member which communicates the interior of the impeller housing with a wash water conduit 52. The wash water conduit 52 includes a portion 54 that connects the outlet of the impeller with the lower wash spray arm 25 and portions 55 and 56 that connect the outlet of the impeller with the upper wash spray arm 23. The spacing between the peripheral edge of the impeller 40 and the sidewall 43 of the portion 49 of the impeller housing varies so as to increase from the top of the housing to the bottom of the housing where it merges with the throat area 50, whereby wash water being circulated by the impeller is forced into the constricted throat area, increasing the speed of the wash water being pumped out through outlet of the impeller housing 42, moving the wash water upwardly into the wash water distribution conduits through which the wash water is supplied to the upper and lower wash spray arms.

To install the impeller housing 42 on the dishwashing machine 10, first the location of the mounted impeller 40 is in the sump 32 to the motor shaft 38 in a suitable manner is identified. Then, the strip of sheet metal 43 is spirally wound around the known location of the impeller 40 and attached to side wall 28 to form the peripheral wall portion of the housing within the sump. The sheet metal strip 43 is connected at its throat portion to the bottom wall 20 of the partition member 17 at aperture 58. Then, the apertured side plate 47 is mounted and secured on the strip of sheet metal 43, completing the impeller housing.

The impeller 40 is a disc-like member 60 having a central mounting hub 61 with a plurality of arcuate vanes 62 equally spaced about the periphery of the disc. In the exemplary embodiment, the impeller has eight vanes each of which is curved radially outward from the hub 61 of the disc member 60 to its circumferential edge. The pump motor 34 rotates the impeller 40 within the impeller housing 42 in a counterclockwise direction as viewed in FIG. 2, with the vanes 62 presenting a concave surface in the direction of rotation. As the impeller 40 is rotated by the pump motor 32, its vanes 62 scoop water and move it through the impeller housing, drawing water in through the inlet aperture 48 and moving the water around the impeller 40 and into the throat area. From the throat area of the impeller housing, the water is moved upwardly into the wash water conduit 51 in the direction of the arrows 63 with a portion of the water being moved through section 54 in the direction of the arrows 68 to the lower wash spray arm and the remaining portion of the water being moved in the direction of arrows 70 through sections 55 and 56 to the upper wash spray arm. The pump delivery capacity is on the order of 140–250 gallons per minute. Testing has demonstrated that an integrated recycling system 12 constructed in accordance with the principles of the invention is as effective as a pump assembly having a cast pump housing, irrespective of where the cast pump housing is located.

Thus it has been shown that the present invention provides an integrated recycling system for dishwashing machines. The recycling system includes an impeller that is mounted within a low cost impeller housing that includes a strip of sheet metal that is wrapped around the impeller defining a peripheral wall for the impeller housing one side of which is closed by the side wall of the machine on which the pump motor is mounted and the other side of which is closed by a side plate having an aperture therein that serves as a water inlet for the housing. The housing encloses the impeller and is shaped so that as water is scooped by the impeller vanes, the water is directed in a generally spiral path, increasing the speed of the water sufficiently to promote the pumping action needed to lift the water upward into the upper and lower spray assemblies of the dishwashing machine. Fabricating the impeller housing from a strip of sheet metal that is formed to the proper shape, eliminates the need to cast or machine fabricate a complex impeller housing for the pump system of the dishwashing machine.

While the invention has been described with reference to preferred embodiments, various modifications can be made without departing from the spirit and scope of the invention as defined in the appended claims.

What is claimed:

1. In a dishwashing machine including means defining a wash chamber, spray means for spraying water within said wash chamber, and a sump serving as a source of water for said spray means, an integrated recycling system for supplying water from said sump to said spray means, said integrated recycling system comprising:

an impeller located within said sump;

an impeller housing located within said sump and enclosing said impeller, said impeller housing having an inlet through which water in said sump is drawn into said impeller housing by the action of said impeller as said impeller is rotated, and an outlet portion in fluid communication with said spray means, with said impeller housing including means defining a peripheral wall having first and second opposing open sides and means closing said first side of said peripheral wall, said impeller housing being mounted on a wall of said sump whereby said second side of said peripheral wall is closed by said wall of said sump; and a drive motor having a drive shaft coupled to said impeller for rotating said impeller within said impeller housing.

2. The dishwashing machine according to claim 1, wherein said peripheral wall defining means includes a strip of sheet metal that is wound around said impeller.

3. The dishwashing machine according to claim 2, wherein said strip of sheet metal is wound around said impeller after said impeller is positioned in said sump and mounted on said drive shaft.

4. The dishwashing machine according to claim 1, wherein said impeller is circular in shape and has a circumferential edge, and wherein said peripheral wall of said impeller housing includes a curved portion which extends around said impeller spaced from its circumferential edge, and a converging throat portion, the spacing between said curved portion and said circumferential edge increasing in the direction of rotation of said impeller to define a diverging water flow path around said impeller which merges through said converging throat portion with said outlet portion of said impeller housing.

5. The dishwashing machine according to claim 4, wherein said outlet portion of said impeller housing is formed by a generally straight wall portion of said peripheral wall, said straight wall portion extending through an aperture in a wall of said sump to communicate the interior of said impeller housing with said spray means.

6. The dishwashing machine according to claim 1, wherein said means closing said first side of said peripheral wall has an aperture therethrough defining said inlet for said impeller housing.

7. The dishwashing machine according to claim 6, wherein said inlet defining aperture is circular in shape and has a diameter of about three inches.

8. The dishwashing machine according to claim 6, wherein said inlet defining aperture is located coaxially with said drive shaft of said drive motor.

9. In a dishwashing machine including means defining a wash chamber, spray means for spraying water within said wash chamber, and a sump serving as a source of water for said spray means, an integrated recycling system for supplying water from said sump to said spray means, said integrated recycling system comprising:

an impeller located within said sump;

an impeller housing located within said sump, said impeller housing having an inlet in fluid communication with the interior of said impeller housing through which water in said sump is drawn into said impeller housing by the action of said impeller as said impeller is rotated, said impeller housing having an outlet in fluid communication with said spray means, said impeller housing including a strip of sheet metal wound around said impeller defining a peripheral wall for said impeller housing, said peripheral wall having first and second sides, said first side of said impeller housing being mounted on a wall of said sump enclosing first side of said impeller housing, and a plate enclosing said second side of said housing, said plate having an opening therethrough defining said inlet; and a drive motor having a drive shaft coupled to said impeller for rotating said impeller.

10. The dishwashing machine according to claim 9, wherein said impeller is circular in shape and has a circumferential edge, and wherein said peripheral wall of said impeller housing includes a curved portion which partially encircles said impeller and being constructed and arranged so that the spacing between said curved portion and the circumferential edge of said impeller differs at different points along the circumferential edge of said impeller.

11. The dishwashing machine according to claim 9, wherein said impeller is circular in shape and has a circumferential edge, and wherein said peripheral wall of said impeller housing includes a curved portion which extends around said impeller spaced from said circumferential edge, the spacing between said curved portion and said circumferential edge increasing in the direction of rotation of said impeller to define a diverging water flow path around the impeller which merges through a converging throat portion with said outlet portion of said impeller housing.

12. The dishwashing machine according to claim 11, wherein said outlet portion of said impeller housing is formed by a generally straight wall portion of said peripheral wall, said straight wall portion extending through an aperture in a wall of said sump to communicate the interior of said impeller housing with said spray means.

13. The dishwashing machine according to claim 9, wherein said opening is circular in shape and has a diameter of about three inches.

14. The dishwashing machine according to claim 13, wherein said opening is located coaxially with said drive shaft of said drive motor.

15. In a dishwashing machine including means defining a wash chamber, spray means for spraying water within said wash chamber, and a sump serving as a source of water for said spray means, an integrated recycling system for supplying water from said sump to said spray means, said integrated recycling system comprising:

a drive motor mounted externally to said sump and having a drive shaft extending into said sump through an aperture in a wall of said sump;

an impeller located within said sump and mounted on said drive shaft;

an impeller housing located within said sump enclosing said impeller, said impeller housing having an opening defining an inlet to the interior of said impeller housing through which water in said sump is drawn into said impeller housing by the action of said impeller as said impeller is rotated and said impeller housing having an outlet in fluid communication with said spray means and through which water drawn into said impeller housing is discharged to be supplied to said spray means, said impeller housing including a strip of sheet metal wound around said impeller to define a peripheral wall for the impeller housing having first and second sides, said first side being secured to said wall of said sump closing said impeller housing on said first side, and a flat plate-like member mounted on said second side of said peripheral wall, closing said second side of said peripheral wall, said plate-like member having an aperture therethrough defining said inlet; and means communicating said outlet with said spray means.

* * * * *